US006846187B2

(12) United States Patent
Yu

(10) Patent No.: US 6,846,187 B2
(45) Date of Patent: Jan. 25, 2005

(54) ELECTRICAL CONNECTOR ASSEMBLY WITH LOCKING MEANS

(75) Inventor: Hung-Chi Yu, Tu-Chen (TW)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/391,149

(22) Filed: Mar. 17, 2003

(65) Prior Publication Data

US 2004/0142586 A1 Jul. 22, 2004

(51) Int. Cl.[7] ..... H01R 12/00
(52) U.S. Cl. ..... 439/74; 439/346
(58) Field of Search ..... 439/74, 75, 55, 439/65, 345, 346

(56) References Cited

U.S. PATENT DOCUMENTS 5,224,866 A * 7/1993 Nakamura et al. ..... 439/81
5,360,353 A * 11/1994 Kinoshita ..... 439/620
5,876,217 A 3/1999 Ito et al. ..... 439/74
5,888,076 A * 3/1999 Itoh et al. ..... 439/74
5,931,689 A 8/1999 Patel ..... 439/346
6,089,876 A * 7/2000 Kuwahara et al. ..... 439/67
6,257,900 B1 * 7/2001 Huang et al. ..... 439/74
6,338,630 B1 * 1/2002 Dong ..... 439/74
6,464,515 B1 * 10/2002 Wu ..... 439/108
6,485,312 B1 * 11/2002 Yu ..... 439/74
2001/0027036 A1 * 10/2001 Goto ..... 439/74

FOREIGN PATENT DOCUMENTS

DE 3929929 C1 * 11/1990
DE 3929929 C1 * 11/1990 ..... H01R/04/50

* cited by examiner

*Primary Examiner*—Michael C. Zarroli
(74) *Attorney, Agent, or Firm*—Wei Te Chung

(57) ABSTRACT

A receptacle connector (1) for electrically connecting with a complementary plug connector (3) includes an insulative housing (10) and a number of terminals (20) retained in the insulative housing. The terminals each include a base portion (21) retained in the insulative housing, a connecting arm (210) extending from a bottom end of the base portion, a mating arm (22) extending upwardly from the connecting arm for connecting with the mating connector and a retaining arm (24) extending upwardly from an outer end of the base portion for engaging with an outer surface of the insulative housing. The base portion is formed with a projection (26) for engaging with the mating connector.

10 Claims, 2 Drawing Sheets

ELECTRICAL CONNECTOR ASSEMBLY WITH LOCKING MEANS

BACKGROUND OF THE INVENTION

1. Field of the Invention

The present invention relates to an electrical connector assembly, and particularly to an electrical connector assembly with retention means for retaining mated receptacle and plug connectors thereof.

2. Description of Related Art

A board-to-board connector assembly is usually used to connect two Printed Circuit Boards (PCBs). The board-to-board connector assembly includes a plug connector and a receptacle connector respectively mounted on the two PCBs. In some instances, when the plug connector is inserted into the receptacle connector, a retention means is required to lock the plug connector in the receptacle connector.

U.S. Pat. Nos. 5,876,217 and 5,931,689 each disclose a board-to-board connector assembly. Referring to FIG. 3 attached herewith, the board-to-board connector assembly of the above mentioned patents includes a receptacle connector 6 and a complementary plug connector 7. The receptacle connector 6 includes an insulative housing 60 and a plurality of terminals 61 retained in the insulative housing 60. The terminals 61 each include a retention arm 64 engaging with the insulative housing 60, a horizontal soldering tail 62 extending from a bottom end of the retention arm 64, a contacting arm 63 extending opposite to the soldering tail 62 and then upwardly from the bottom end of the retention arm 64 and a locking arm 65 extending parallel to the retention arm 64. The soldering tail 62 is soldered on a first PCB 8. The locking arm 65 is formed with a projection 66 for engaging with the plug connector 7. The plug connector 7 includes a dielectric base 70 and a plurality of contacts 71 retained in the dielectric base 70. The contacts 71 each includes a soldering tail 72 for soldering on a second PCB 9 and a contacting arm 73 for electrically connecting with a corresponding terminal 61 of the receptacle connector 6. In mating, the projections 66 of corresponding terminals 61 are respectively received in locking holes 74 defined in the dielectric base 70 to lock the receptacle and the plug connectors 6, 7 together. The mating of the plug and the receptacle connectors 7, 6 establishes an electrical connection between the first PCB 8 and the second PCB 9.

It is obvious that the terminals 61 with differently configured soldering tails 62, retention arms 64 and locking arms 65 are complex in the structure thereof, and in turn the corresponding structure of the insulative housing 60 for receiving the terminals 61 is also complex. Therefore, the difficulty of manufacturing the insulative housing 60 and the terminals 61 is increased and the manufacturing cost of the insulative housing 60 and the terminals 61 is increased.

Hence, an improved electrical connector assembly is required to overcome the disadvantage of the conventional electrical connector assembly.

SUMMARY OF THE INVENTION

Accordingly, an object of the present invention is to provide a structurally simplified electrical connector assembly having a locking means for securing an electrical connection between mated receptacle and plug connectors thereof.

In order to achieve the object set forth, an electrical connector assembly electrically connecting a first and a second PCBs includes a plug connector and a receptacle connector. The receptacle connector is mounted on the first PCB and includes an insulative housing and a plurality of terminals retained in the insulative housing. The insulative housing includes a sidewall and a tongue plate which together with the sidewall defines a receiving slot therebetween for receiving the plug connector. The terminals each include a base portion, a retaining arm extending from an outer end of the base portion for engaging with an outer surface of the insulative housing, a connecting arm extending inwardly from a bottom end of the base portion and a mating arm extending upwardly from the connecting arm. The base portion is formed with a barb for engaging with the insulative housing and a projection extending into the receiving slot. The plug connector is mounted on the second PCB and includes a dielectric base and a plurality of contacts retained in the dielectric base. The dielectric base defines a plurality of locking holes for engageably receiving corresponding projections of the terminals.

Other objects, advantages and novel features of the invention will become more apparent from the following detailed description of the preferred embodiment when taken in conjunction with the accompanying drawings.

DETAILED DESCRIPTION OF THE INVENTION

Figure 1:
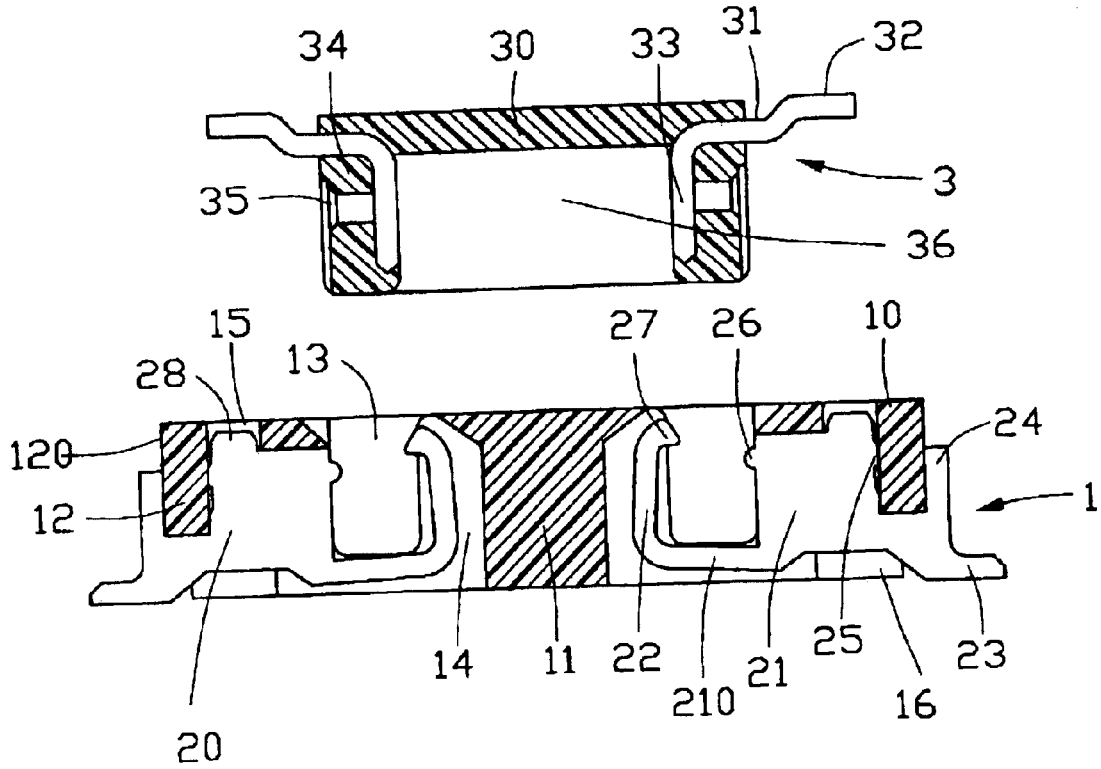
FIG. 1 is an exploded, cross-sectional view of an electrical connector assembly of the present invention.

Reference will now be made to the drawing figures to describe the present invention in detail.

Figure 2:
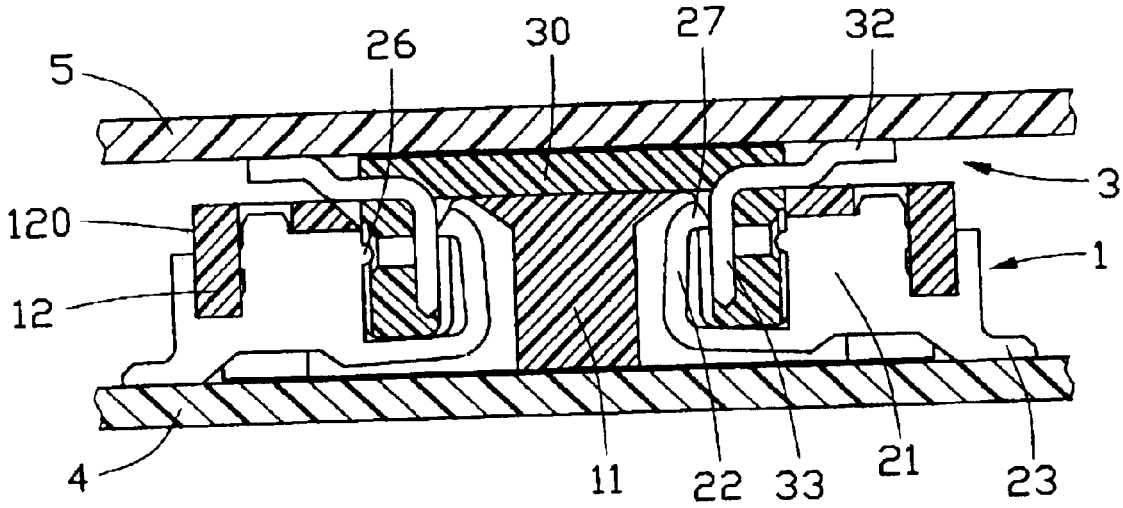
FIG. 2 is an assembled, cross-sectional view of the electrical connector assembly in FIG. 1 together with a first and a second PCBs.
Figure 3:
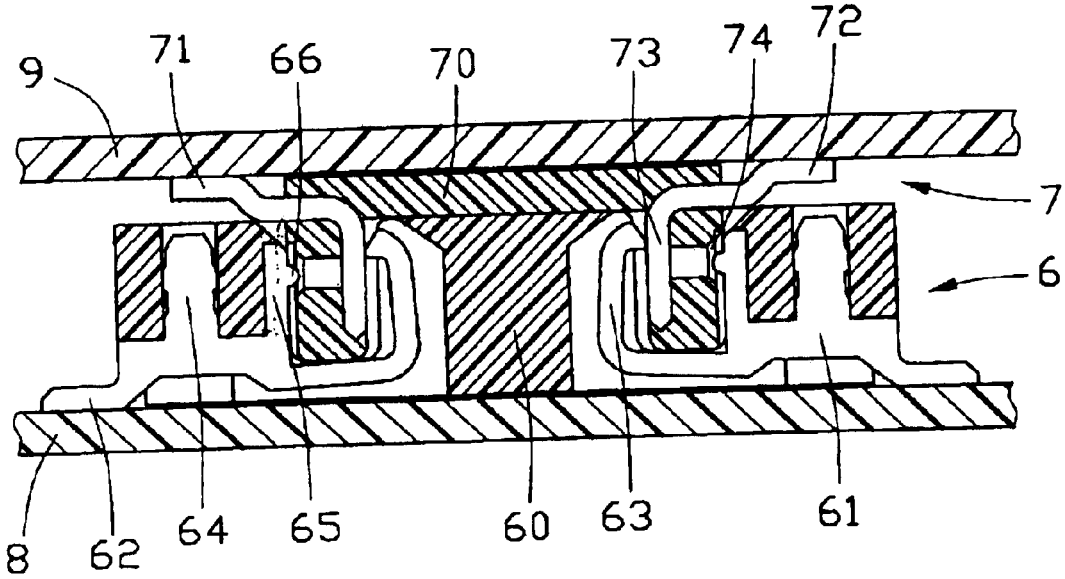
FIG. 3 (PRIOR ART)
FIG. 3 is an assembled, cross-sectional view of an electrical connector assembly of prior art, together with two PCBs.

Referring to FIGS. 1 and 2, an electrical connector assembly of the present invention is used to electrically connect a first PCB 4 and a second PCB 5. The electrical connector assembly includes a receptacle connector 1 and a plug connector 3 respectively mounted on the first PCB 4 and the second PCB 5. The receptacle connector 1 includes an insulative housing 10 and a plurality of terminals 20 retained in the insulative housing 10. The insulative housing 10 has two opposite sidewalls 12 and a tongue plate 11 between the opposite walls 12. The tongue plate 11 and the sidewall 12 together define a receiving slot 13 therebetween. The tongue plate 11 defines a plurality of cavities 14 communicating with the receiving slot 13 on opposite surface thereof. The sidewalls 12 each define a plurality of recesses 16 at a bottom end thereof communicating with the receiving slot 13. In addition, the sidewalls 12 each define a plurality of retaining holes 15 communicating with corresponding recesses 16.

Each of the terminals 20 includes a base portion 21, a connecting arm 210 extending inwardly from a bottom end of the base portion 21, a mating arm 22 extending upwardly from an inner end of the connecting arm 210, a soldering tail 23 extending opposite to the connecting arm 210 and a retaining arm 24 extending upwardly from an outer end of the base portion 21. The base portion 21 is formed with a projection 26 extending into the receiving slot 13 for engaging with the plug connector 3 and a barb 25 extending opposite to the projection 26 for engaging with the insulative housing 10. The mating arm 22 comprises a contacting tip 27 extending into the receiving slot 13 from a top end thereof. In addition, the terminals 20 each comprise a pole 28 extending upwardly from a top end of the base portion 21.

In assembly, the terminals 20 are inserted into the insulative housing 10 along a bottom-to-top direction with the base portions 21 received in corresponding recesses 16 and the mating arms 22 received in corresponding cavities 14 of the tongue plate 11. The poles 28 are received in corresponding retaining holes 15 and the retaining arms 24 engage with an outer surface 120 of the insulative housing 10. The base portions 21 and the retaining arms 24 hold corresponding portions of the insulative housing with the barbs 25 engaging with the insulative housing 10 and the retaining arm 24 engage with the outer surface 120 of the insulative housing 10 for securely retaining the terminals 20 in the insulative housing 10.

The plug connector 3 includes a dielectric base 30 and a plurality of contacts 31 received in the dielectric base 30. The dielectric base 30 includes a pair of opposite sidewalls 34. The opposite sidewalls 34 together define a receiving room 36 therebetween and a plurality of locking holes 35 communicating with the receiving room. The contacts 31 each includes a contacting arm 33 and a soldering tail 32 for soldering on the second PCB 5.

In use, the plug connector 3 is inserted into the receptacle connector 1 with the sidewalls 34 of the plug connector 3 received in corresponding receiving slots 13 of the receptacle connector 1 and the tongue plate 11 of the receptacle connector 1 received in the receiving room 36 of the plug connector 3. The contacting arms 33 contact with corresponding contacting tips 27 of the terminals 20 thereby establishing an electrical connection between the plug connector 3 and the receptacle connector 1 and in turn an electrical connection between the first and the second PCBs 4, 5. The projections 26 of the terminals 20 of the receptacle connector 1 are engageably received in corresponding locking holes 35 of the dielectric base 30 of the plug connector 3 whereby the plug connector 3 and the receptacle connector 1 are securely mated together.

The terminals 20 are simple in the structure thereof and are easy to manufacture. In turn, corresponding structure of the insulative housing 10 is simple and easy to manufacture.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for electrically connecting with a mating connector, comprising:

an insulative housing defining an outer, surface; and a plurality of terminals being retained in the insulative housing, each terminal comprising a base portion received in the insulative housing, a retaining arm extending from the base portion and engaging with the outer surface of the insulative housing and a mating arm formed with a contacting tip for electrically connecting with the mating connector, the base portion comprising a projection adapted for locking with the mating connector; wherein the base portion and the retaining arm hold a corresponding portion of the insulative portion under duress.

2. The electrical connector as claimed in claim 1, wherein each of the terminals comprises a connecting arm extending from the base portion, and a wherein the mating arm extends upwardly from the connecting arm.

3. The electrical connector as claimed in claim 2, wherein the insulative housing comprises a tongue plate and a sidewall, the tongue plate defining a plurality of cavities for receiving corresponding mating arms and the sidewall defining a plurality of recesses for receiving corresponding base portions.

4. The electrical connector as claimed in claim 3, wherein the terminals each comprise a pole extending upwardly from a top end of the base portion and the sidewall defines a plurality of retaining holes communicating with corresponding recesses for receiving corresponding poles.

5. The electrical connector as claimed in claim 1, wherein the base portion comprises a barb opposite to the projection and engaging with the insulative housing.

6. An electrical connector assembly for electrically connecting a first and a second PCBs, comprising:

a receptacle connector adapted for being mounted on the first PCB, comprising:

an insulative housing defining an outer surface; and a plurality of terminals being retained in the insulative housing and each comprising a base portion and a retaining arm extending from the base portion for engaging with the outer surface of the insulative housing, the base portion being formed with a barb for engaging with the insulative housing and a projection opposite to the barb; and a plug connector adapted for being mounted on the second PCB and comprising a dielectric base and a plurality of contacts retained in the dielectric base, the dielectric base defining a plurality of locking holes on an outer surface thereof to engageably receive corresponding projections, respectively.

7. The electrical connector assembly as claimed in claim 6, wherein insulative housing comprises a sidewall and a tongues plate, the sidewall and the tongue plate defining a receiving slot therebetween for receiving the dielectric base.

8. The electrical connector assembly as claimed in claim 6, wherein the terminals each comprise a connecting arm extending inwardly from the base portion and a mating arm extending upwardly from the connecting arm for connecting with a corresponding contact.

9. An electrical connector assembly comprising:

mated first and second connector, said first connector including a first insulative housing with a plurality of first contacts therein; a plurality of apertures formed in outer faces of the first insulative housing in lateral alignment with the corresponding first contacts, respectively;

said second connector including a second insulative housing with a plurality of second contacts disposed in corresponding recesses thereof and mated with the corresponding first contacts, respectively;

each of said second contacts including a relatively large base portion with a relatively slim connecting arm inwardly extending from an inner side thereof, a relatively slim mating arm extending from the connecting arm with a contacting section thereon, a space defined between the base portion and the mating arm and receiving the first insulative housing therein, a projection formed on said inner side and spatially above the connecting arm, a barb extending from an outer side of the base portion and interferentially engaged with an inner side of a wall of the second insulative housing, and a small pole upwardly extending from a top portion of the base portion and located in a retaining hole in the second insulative housing, said retaining hole being in communication with the corresponding recess; wherein said projection is retainably received in the corresponding aperture when said first and second connectors are mated with each other.

10. The assembly as claimed in claim 9, wherein the second contact further includes an upright retaining arm extending from a bottom portion of the base portion and abutting against an outer side of the wall of the second insulative housing and cooperating with the barbs to retainably sandwich the wall therebetween.

* * * * *